US010227678B2

(12) United States Patent
Suzuki et al.

(10) Patent No.: US 10,227,678 B2
(45) Date of Patent: Mar. 12, 2019

(54) COBALT-NICKEL BASE ALLOY AND METHOD OF MAKING AN ARTICLE THEREFROM

(75) Inventors: Akane Suzuki, Clifton Park, NY (US); Andrew John Elliott, Westminster, SC (US); Michael Francis Xavier Gigliotti, Jr., Glenville, NY (US); Kathleen Blanche Morey, Scotia, NY (US); Pazhayannur Subramanian, Niskayuna, NY (US)

(73) Assignee: GENERAL ELECTRIC COMPANY, Schenectady, NY (US)

( * ) Notice: Subject to any disclaimer, the term of this patent is extended or adjusted under 35 U.S.C. 154(b) by 482 days.

(21) Appl. No.: 13/156,638

(22) Filed: Jun. 9, 2011

(65) Prior Publication Data

US 2012/0312434 A1 Dec. 13, 2012

(51) Int. Cl.
*C22C 19/07* (2006.01)
*C22C 19/05* (2006.01)
*C22F 1/10* (2006.01)

(52) U.S. Cl.
CPC ..... *C22C 19/07* (2013.01); *C22C 19/057* (2013.01); *C22F 1/10* (2013.01)

(58) Field of Classification Search
CPC ..... C22C 19/057; C22C 19/07
(Continued)

(56) References Cited

U.S. PATENT DOCUMENTS 3,146,136 A 8/1964 Bird
4,078,922 A 3/1978 Magyar et al.
(Continued)

FOREIGN PATENT DOCUMENTS

EP 0561179 A2 9/1993
EP WO 98/45491 10/1998
(Continued)

OTHER PUBLICATIONS

C. Cui, D. Ping, Y. Gu, H. Harada, A New Co-Base Superalloy Strengthened by γ' Phase, Materials Transactions, (2006) pp. 2099 to 2102, vol. 47, No. 8, High Temperature Materials Center, National Institute for Materials Science, Tsukuba 305-0047, Japan.
(Continued)

*Primary Examiner* — Christopher S Kessler
(74) *Attorney, Agent, or Firm* — GE Global Patent Operation; John Darling

(57) ABSTRACT

A high-temperature, high-strength, oxidation-resistant cobalt-nickel base alloy is disclosed. The alloy includes, in weight percent: about 3.5 to about 4.9% of Al, about 12.2 to about 16.0% of W, about 24.5 to about 32.0% Ni, about 6.5% to about 10.0% Cr, about 5.9% to about 11.0% Ta, and the balance Co and incidental impurities. A method of making an article having high-temperature strength, cyclic oxidation resistance and corrosion resistance is disclosed. The method includes forming a high-temperature, high-strength, oxidation-resistant cobalt-nickel base alloy as described herein; forming an article from the alloy; solution-treating the alloy by a solution heat treatment; and aging the alloy by providing at least one aging heat treatment at an aging temperature that is less than the gamma-prime solvus temperature, wherein the alloy is configured to form a continuous, protective, adherent oxide layer on an alloy surface upon exposure to a high-temperature oxidizing environment.

16 Claims, 11 Drawing Sheets

| Alloy | Alloy Compositions (wt%) | | | | | | | | | | |
|---|---|---|---|---|---|---|---|---|---|---|---|
| | Co | Ni | Al | W | Cr | Ta | Mo | C | B | Y | La |
| Co-01 | 35.9 | 30.0 | 4.4 | 13.2 | 9.5 | 6.9 | | 0.05 | 0.005 | | 0.05 |
| Co-02 | 37.9 | 26.5 | 3.5 | 15.0 | 7.0 | 10.0 | | 0.05 | 0.005 | 0.05 | |
| Co-03 | 37.9 | 28.5 | 3.5 | 15.5 | 6.0 | 7.0 | 1.5 | 0.05 | 0.005 | 0.05 | |
| Co-04 | 39.9 | 25.0 | 3.7 | 16.0 | 10.0 | 5.3 | | 0.05 | 0.005 | | |

(58) Field of Classification Search
USPC ..... 420/435; 148/408, 674, 707
See application file for complete search history.

(56) References Cited

U.S. PATENT DOCUMENTS

| | | | |
|---|---|---|---|
| 4,152,181 | A | 5/1979 | Hirakis |
| 5,439,640 | A | 8/1995 | Heck et al. |
| 6,177,046 | B1 | 1/2001 | Simkovich |
| 7,094,475 | B2 | 8/2006 | Schnell |
| 7,901,790 | B2 | 3/2011 | Arikawa |
| 9,034,247 | B2 | 5/2015 | Suzuki et al. |
| 2005/0260346 | A1 | 11/2005 | Heng |
| 2008/0038575 | A1 | 2/2008 | Renteria |
| 2008/0185075 | A1 | 8/2008 | Ishida et al. |
| 2008/0185078 | A1 | 8/2008 | Ishida et al. |
| 2008/0206090 | A1 | 8/2008 | Ishida et al. |
| 2008/0260570 | A1 | 10/2008 | Harada |
| 2010/0061883 | A1 | 3/2010 | Nazmy et al. |
| 2010/0291406 | A1 | 11/2010 | Suzuki et al. |
| 2011/0268989 | A1 | 11/2011 | Suzuki et al. |
| 2012/0312426 | A1 | 12/2012 | Suzuki et al. |

FOREIGN PATENT DOCUMENTS

| | | | |
|---|---|---|---|
| EP | 1195446 | | 4/2002 |
| EP | 1410872 | A1 | 4/2004 |
| EP | 1584871 | A2 | 12/2006 |
| EP | 2045345 | A1 | 8/2009 |
| EP | 2251446 | A1 | 11/2010 |
| EP | 2256222 | A1 | 12/2010 |
| EP | 2383356 | A1 | 11/2011 |
| JP | 613859 | A | 1/1986 |
| JP | 62228444 | | 7/1987 |
| JP | H04-235261 | | 8/1992 |
| JP | 2009-228024 | | 8/2009 |
| JP | 2009-228024 | | 10/2009 |
| JP | 02141523 | | 11/2009 |
| WO | 199845491 | A1 | 10/1998 |

OTHER PUBLICATIONS

J. Sato, T. Omari, K. Oikawa, I. Ohnuma, R. Kainuma, K. Ishida, "Cobalt-Base High-Temperature Alloys", Science, vol. 312, (2006) pp. 90-91.

Frances, M. et al. Hot Corrosion Behavior of Low Pressure Plasma Sprayed NiCoCrAlY + Ta Coatings on Nickel Base Superalloys, J.Vac.Sci. Technology A. 3(6) Nov./Dec. 1985.

European Search Report for EP 12171280.6-1215 dated Sep. 18, 2012.

Machine translation of JP 2009-228024.

Patent Abstract of Japan, English abstract of JP 2009-228024.

Durand-Charre, "The Microstructure of Superallos", (Sic), pp. 68, 1997.

European Search Report and Opinion issued in connection with corresponding EP Application No. 12171278.0 dated Oct. 1, 2012.

Chinese Office Action issued in connection with corresponding CN Application No. 201210187802.9 dated Mar. 30, 2015.

European Opposition filed issued in connection with corresponding EP Application No. 12171278.0 dated Oct. 22, 2015.

| Alloy | Alloy Compositions (wt%) | | | | | | | | | | |
|---|---|---|---|---|---|---|---|---|---|---|---|
| | Co | Ni | Al | W | Cr | Ta | Mo | C | B | Y | La |
| Co-01 | 35.9 | 30.0 | 4.4 | 13.2 | 9.5 | 6.9 | | 0.05 | 0.005 | | 0.05 |
| Co-02 | 37.9 | 26.5 | 3.5 | 15.0 | 7.0 | 10.0 | | 0.05 | 0.005 | 0.05 | |
| Co-03 | 37.9 | 28.5 | 3.5 | 15.5 | 6.0 | 7.0 | 1.5 | 0.05 | 0.005 | 0.05 | |
| Co-04 | 39.9 | 25.0 | 3.7 | 16.0 | 10.0 | 5.3 | | 0.05 | 0.005 | | |

FIG. 1

| Alloy | Liquidus | Solidus | γ′ solvus | Solution window |
|---|---|---|---|---|
| Co-01 | 1401°C | 1339°C | 1090°C | 249°C |
| Co-02 | 1406°C | 1334°C | 1118°C | 216°C |
| Co-03 | 1417°C | 1349°C | 1090°C | 259°C |
| Co-04 | 1412°C | 1345°C | 1035°C | 310°C |

FIG. 2

Creep Rupture Life

| Alloy | Material preparation | Temperature (°F) | Stress (ksi) | Rupture life (h) |
|---|---|---|---|---|
| Co-01 | cast, HIP | 1800 | 10 | 195.2 |
| | | 1800 | 15 | 134.3 |
| | | 1600 | 30 | 528.2 |
| | | 1600 | 35 | 349.8 |
| Co-02 | cast, HIP | 1800 | 10 | 195.2 |
| | | 1800 | 15 | 134.3 |
| | | 1600 | 30 | 528.2 |
| | | 1600 | 35 | 349.8 |
| Co-03 | cast, HIP | 1800 | 10 | 139.3 |
| Co-04 | cast, HIP | 1800 | 10 | 226.3 |
| | | 1800 | 15 | 44 |
| | | 1600 | 30 | 731.8 |
| | | 1600 | 35 | 225.6 |
| Co-01 | extruded | 1800 | 10 | 223.9 |
| | | 1800 | 15 | 50.5 |
| | | 1600 | 30 | 742.7 |
| | | 1600 | 35 | 216.1 |
| Co-02 | extruded | 1800 | 10 | 200.3 |
| | | 1800 | 15 | 122.5 |
| | | 1600 | 30 | 1382.9 |
| | | 1600 | 35 | 646.1 |
| Co-03 | extruded | 1800 | 10 | 226.9 |
| | | 1800 | 15 | 85.8 |
| | | 1600 | 30 | 762 |
| | | 1600 | 35 | 429.6 |
| Co-04 | extruded | 1800 | 10 | 334.9 |
| | | 1800 | 15 | 28.2 |
| | | 1600 | 30 | 444.3 |
| | | 1600 | 35 | 119.5 |

FIG. 8

| (wt%) | Co | Ni | Cr | Al | W | Ta | C | B | Hf | Si | La |
|---|---|---|---|---|---|---|---|---|---|---|---|
| Co-01 | 35.9 | 30 | 9.5 | 4.4 | 13.2 | 6.9 | 0.05 | 0.005 | | | 0.05 |
| N-Co1 | bal. | - | - | 3.4 | 26 | 5.1 | 0.2 | 0.05 | 0.1 | 0.1 | |
| N-Co2 | bal. | - | - | 8 | 27.25 | 5.2 | 0.2 | 0.05 | 0.1 | 0.1 | |
| I-Co31 | bal. | - | 3.7 | 3.6 | 23.9 | 5.2 | | | | | |
| I-Co32 | bal. | 16.6 | - | 3.8 | 26 | 5.1 | | | | | |

N-Co1

N-Co2

I-Co31

I-Co32

Co-01

COBALT-NICKEL BASE ALLOY AND METHOD OF MAKING AN ARTICLE THEREFROM

BACKGROUND OF THE INVENTION

A high-temperature, high-strength Co—Ni base alloy and a method of making an article therefrom are disclosed. More particularly, a gamma prime (γ') strengthened Co—Ni base alloy that is capable of forming a protective, adherent oxide surface layer or scale is disclosed together with a process for producing the same. These alloys are suitable for making articles for applications where high temperature strength and oxidation resistance are required.

In a number of high-temperature applications, particularly for use in industrial gas turbines, as well as engine members for aircraft, chemical plant materials, engine members for automobile such as turbocharger rotors, high temperature furnace materials and the like, high strength is needed under a high temperature operating environment, as well as excellent oxidation resistance. In some of these applications, Ni-base superalloys and Co-base alloys have been used. These include Ni-base superalloys which are strengthened by the formation of a γ' phase having an ordered face-centered cubic $L1_2$ structure: $Ni_3(Al,Ti)$, for example. It is preferable that the γ' phase is used to strengthen these materials because it has an inverse temperature dependence in which the strength increases together with the operating temperature.

In high-temperature applications where corrosion resistance and ductility are required, Co-base alloys are commonly used alloys rather than the Ni-base alloys. The Co-base alloys are strengthened with $M_{23}C_6$ or MC type carbides, including $Co_3Ti$, $Co_3Ta$, etc. These have been reported to have the same $L1_2$-type structure as the crystal structure of the γ' phase of the Ni-base alloys. However, $Co_3Ti$ and $Co_3Ta$ have a low stability at high temperature. Thus, even with optimization of the alloy constituents these alloys have an upper limit of the operating temperature of only about 750° C., which is generally lower than the γ' strengthened Ni-base alloys.

A Co-base alloy that has an intermetallic compound of the $L1_2$ type [$Co_3(Al,W)$] dispersed and precipitated therein, where part of the Co may be replaced with Ni, Ir, Fe, Cr, Re, or Ru, while part of the Al and W may be replaced with Ni, Ti, Nb, Zr, V, Ta or Hf, has been disclosed in US2008/0185078. Under typical oxidation conditions, the Co-base alloys strengthened with $Co_3(Al,W)$ typically form cobalt-rich oxides, such as CoO, $Co_3O_4$ and $CoWO_4$, which are not protective and result in poor oxidation and corrosion resistance. While good high-temperature strength and microstructure stability have been reported for this alloy, further improvement of the high-temperature properties are desirable, including high-temperature oxidation and corrosion resistance, particularly high-temperature oxidation resistance.

BRIEF DESCRIPTION OF THE INVENTION

According to one aspect of the invention, a high-temperature, high-strength, oxidation-resistant cobalt-nickel base alloy is disclosed. The alloy includes, in weight percent: about 3.5 to about 4.9% of Al, about 12.2 to about 16.0% of W, about 24.5 to about 32.0% Ni, about 6.5% to about 10.0% Cr, about 5.9% to about 11.0% Ta, and the balance Co and incidental impurities.

According to another aspect of the invention, a method of making an article having high-temperature strength, oxidation resistance and corrosion resistance is disclosed. The method includes: forming an alloy, comprising, in weight percent: about 3.5 to about 4.9% of Al, about 12.2 to about 16.0% of W, about 24.5 to about 32.0% Ni, about 6.5% to about 10.0% Cr, about 5.9% to about 11.0% Ta, and the balance Co and incidental impurities; forming an article from the alloy; solution-treating the alloy by a solution heat treatment at a solutionizing temperature above the gamma prime solvus temperature and below the solidus temperature; and aging the alloy by providing at least one aging heat treatment at an aging temperature that is less than the gamma-prime solvus temperature for a predetermined aging time to form an alloy microstructure that comprises a plurality of gamma prime precipitates comprising $(Co,Ni)_3(Al,W)$ and is substantially free of a CoAl phase having a B2 crystal structure.

These and other advantages and features will become more apparent from the following description taken in conjunction with the drawings.

BRIEF DESCRIPTION OF THE DRAWINGS

The subject matter, which is regarded as the invention, is particularly pointed out and distinctly claimed in the claims at the conclusion of the specification. The foregoing and other features, and advantages of the invention are apparent from the following detailed description taken in conjunction with the accompanying drawings in which:

FIG. 1 is a table illustrating the constituents comprising representative embodiments of the Co—Ni-base alloys disclosed herein;

FIG. 2 is a table illustrating thermodynamic characteristics of the alloys of FIG. 1;

FIG. 8 is a table illustrating the creep rupture life of the alloys of FIG. 1 as a function of alloy processing, temperature and applied stress;

Figure 3:
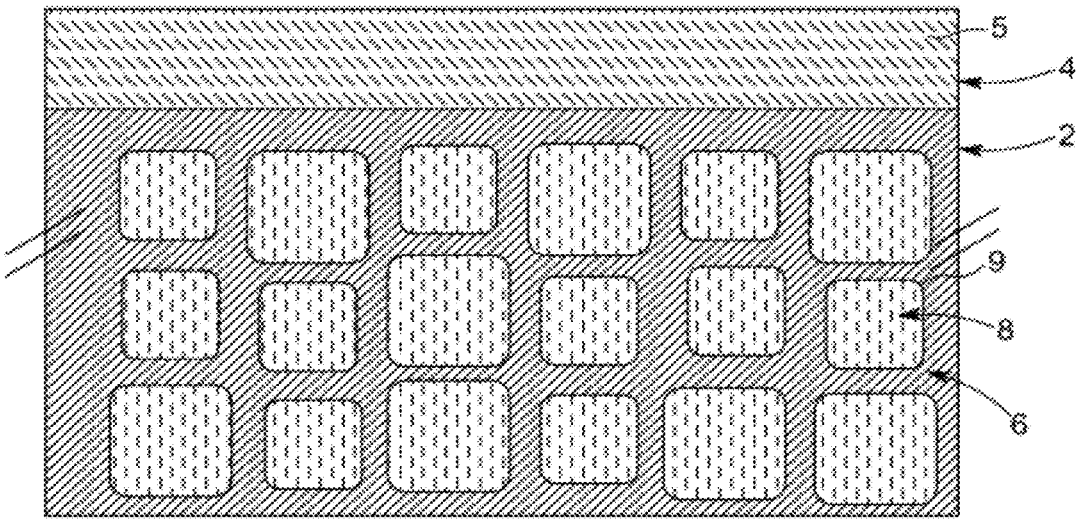
FIG. 3 is a schematic cross-sectional view of an exemplary embodiment of an article of FIG. 13 taken along section 3-3 and an exemplary embodiment of a Co—Ni alloy as disclosed herein.
Figure 4:
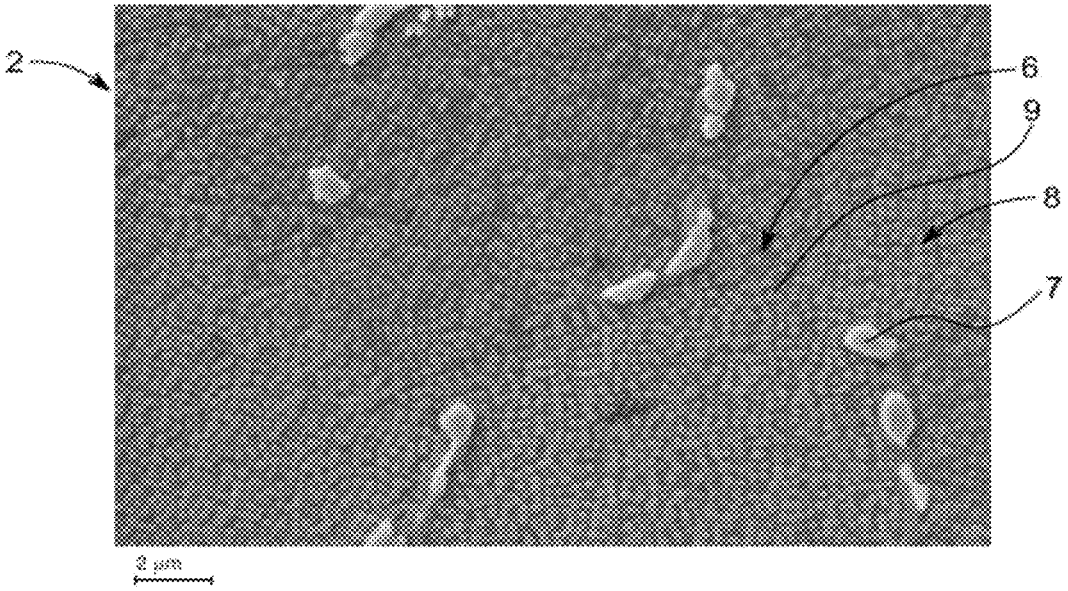
FIG. 4 is a scanning electron microscope image of an exemplary embodiment of the alloy Co-01 of FIG. 1 illustrating aspects of the alloy microstructure.

The detailed description explains embodiments of the invention, together with advantages and features, by way of example with reference to the drawings.

DETAILED DESCRIPTION OF THE INVENTION

Referring to the figures, and more particularly FIGS. 1, 3, 4 and 12E, Co—Ni-base alloys 2 having a desirable combination of high temperature strength, ductility, creep rupture strength, low cycle fatigue strength, high-temperature oxidation resistance and formability are disclosed. These Co—Ni-base alloys 2 constitute superalloys and have a melting temperature that is higher than typical Ni-base superalloys by about 50° C. and comparable to that of many Co-base alloys. The diffusion coefficient of substitutional elements in the lattice of the Co—Ni-base alloys is generally smaller than that of Ni-base alloys. Therefore, the Co—Ni-base alloys 2 possess good microstructural stability and mechanical properties at high temperatures. Further, thermo-mechanical processing of the Co—Ni-base alloy 2 can be performed by forging, rolling, pressing, extrusion, and the like.

Not to be limited by theory, these alloys have greater high-temperature oxidation resistance than conventional Co-based and Ni-based alloys due to the enhanced ability to form stable protective oxide layers, which are particularly suited for the hot gas paths of turbine engines, such as industrial gas turbine engines. This enhanced stability is due, in part, to the formation of a continuous, protective adherent oxide layer 4. The oxide layer 4 generally includes aluminum oxide, mainly alumina, but may also comprise a complex oxide of aluminum as well as oxides of other alloy constituents, including Ni, Cr, Ta and W. These oxides form over time on the surface of articles 10 (shown in FIG. 13) formed from these alloys 2 when they are exposed to a high-temperature oxidizing environment during use or otherwise, such as exposure at about 1,600° F. or more in air, and even more particularly about 1,800° F. or more in air, and even more particularly about 2,000° F. or more in air. When various high-temperature articles 10 made of these alloys, such as, for example, various turbine engine components, including blades, vanes, shrouds, liners, transition pieces, and other components used in the hot gas flowpath of an industrial gas turbine engine, the articles form a continuous, protective adherent oxide layer 4 on the surface in the high-temperature oxidizing environment that exists during operation of the engine. Many Co-base alloys use formation of chromia to achieve good oxidation resistance. However, chromia scale is not protective above 1800° F. due to the decomposition of chromia into $CrO_3$. Alumina is a more stable oxide and has slower growth rate than chromia. Therefore, the alloys disclosed herein that form oxides comprising alumina are preferred over chromia-forming alloys, and can be used at higher temperatures. This enhanced stability during operation also extends to engine components with various protective coatings, including various bond coats, thermal barrier coatings, and combinations thereof. Many gas turbine components are coated, but the oxidation resistance of the coated materials is affected by the oxidation resistance of the underlying substrate material. Typically, substrate materials with good oxidation resistance provide better oxidation resistance of the coated materials and better coating compatibility.

Figure 12A:
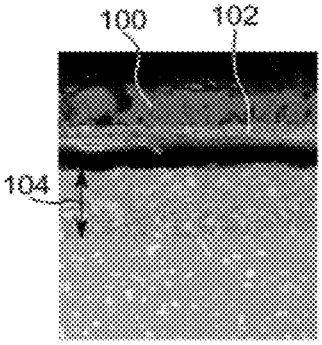
FIGS. 12A-12E are photomicrographs of sections of the alloys of FIG. 10 illustrating the microstructures of the alloys proximate their surfaces after exposure at 1800° F. for 100 hours in an isothermal oxidizing environment.
Figure 12B:
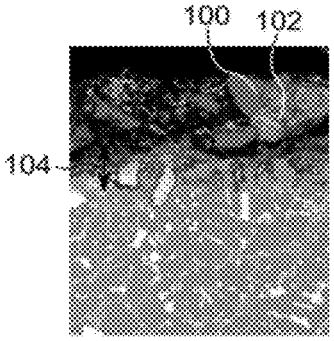
Figure 12C:
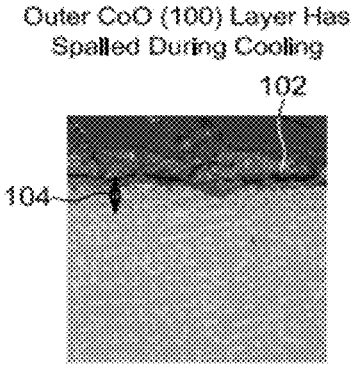
Figure 12D:
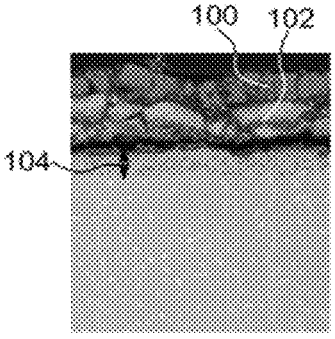
Figure 12E:
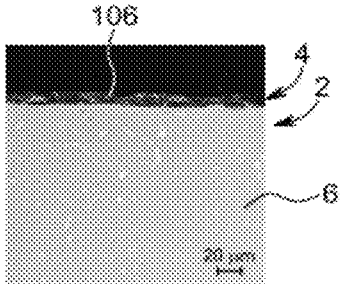

Referring to FIGS. 1, 3 and 12E, the high-temperature, high-strength, oxidation-resistant cobalt-nickel base alloys 2 disclosed herein generally comprise, in weight percent, about 3.5 to about 4.9% of Al, about 12.2 to about 16.0% of W, about 24.5 to about 32.0% Ni, about 6.5% to about 10.0% Cr, about 5.9% to about 11.0% Ta, and the balance Co and incidental impurities. The alloy composition range was selected to provide preferential outward diffusion of alloy constituents, including Al, to form a continuous, protective adherent oxide layer 4 on the surface. In one embodiment (e.g., alloy Co-01), the alloy 2 includes, in weight percent, about 3.9 to about 4.9% of Al, about 12.2 to about 14.2% of W, about 28.0 to about 32.0% Ni, about 9.0% to about 10.0% Cr, about 5.9% to about 7.9% Ta, and the balance Co and incidental impurities, and more particularly, in weight percent, 4.4% of Al, 13.2% of W, 30.0% Ni, 9.5% Cr, 6.9% Ta, and the balance Co and incidental impurities. In another embodiment (e.g., alloy Co-02), the alloy 2 includes, in weight percent, about 3.5 to about 4.0% of Al, about 14.0 to about 16.0% of W, about 24.5 to about 28.5% Ni, about 6.5% to about 7.5% Cr, about 9.0% to about 11.0% Ta, and the balance Co and incidental impurities, and more particularly, in weight percent, 3.5% of Al, 15.0% of W, 26.5% Ni, 7.0% Cr, 10.0% Ta, and the balance Co and incidental impurities.

The amount of alloying elements will generally be selected to provide sufficient Ni to form a predetermined volume quantity of $[(Co,NO_3(Al,W)]$ precipitates, which contribute to the desirable high-temperature alloy characteristics described above. More particularly, in certain embodiments (e.g., alloy Co-01), the alloy may include about 28% to about 32% by weight of Ni, and even more particularly may include about 30% by weight of Ni. In other embodiments (e.g., alloy Co-02), the alloy may include about 24.5% to about 28.5% by weight of Ni, and even more particularly may include about 26.5% by weight of Ni.

The Al amount will generally be selected to provide a tightly adherent surface oxide layer 4 that includes aluminum oxide, and more particularly that includes alumina 5 ($Al_2O_3$). Generally, the alloy comprises about 3.5% to about 4.9% Al by weight of the alloy, with greater amounts of Al generally providing alloys having more desirable combination of mechanical, oxidation and corrosion properties, particularly that providing the most continuous, protective, adherent oxide layers 4. More particularly, in certain embodiments (e.g., alloy Co-01), the alloy may include about 3.9% to about 4.9% by weight of Al, and even more particularly may include about 4.4% by weight of Al. In other embodiments (e.g., alloy Co-02), the alloy may include about 3.5% to about 4.0% by weight of Al, and even more particularly may include about 3.5% by weight of Al. This may include embodiments that include greater than about 4% by weight of Al and that favor the formation of alumina, as well as embodiments that include about 4% or less by weight of Al and that may form complex oxides that may also include various aluminum oxides, including alumina, as well as oxides of other of the alloy constituents.

The Cr amount will also generally be selected to promote formation of a continuous, protective, adherent oxide layer 4 on the surface of the substrate alloy. The addition of Cr particularly promotes the formation of alumina. Generally, the alloy comprises about 6.5% to about 10.0% Cr by weight of the alloy, with greater amounts of Cr generally providing alloys having more desirable combination of mechanical, oxidation and corrosion properties. More particularly, in certain embodiments (e.g., alloy Co-01), the alloy may include about 9.0% to about 10.0% by weight of Cr, and even more particularly may include about 9.5% by weight of Cr. In other embodiments (e.g., alloy Co-02), the alloy may include about 6.5% to about 7.5% by weight of Cr, and even more particularly may include about 7.0% by weight of Cr. Additions of Cr destabilizes γ'-$(Co,Ni)_3(Al,W)$ phase. The amount of Cr has to be carefully chosen considering the levels of γ' stabilizing elements, including Ta, Ni, Al, to achieve balance of high temperature strength and environmental resistance.

The Co—Ni-base alloys disclosed herein generally comprise an alloy microstructure that includes a solid-solution gamma (γ) phase matrix 6, where the solid-solution comprises (Co, Ni) with various other substitutional alloying additions as described herein. The alloy microstructures also includes a gamma prime (γ') phase 8 that includes a plurality of dispersed precipitate particles 9 that precipitate in the gamma matrix 6 during processing of the alloys as described herein. The γ' precipitates act as a strengthening phase and provide the Co—Ni-base alloys with their desirable high-temperature characteristics. The alloy microstructures also may include other phases distributed in the gamma (γ) phase matrix 6, such as $Co_7W_6$ precipitates 7. Alloying additions other than those described above may be used to modify the gamma phase, such as to promote the formation and growth of the oxide layer 4 on the surface, or to promote the formation and affect the characteristics of the γ' precipitates as described herein.

The γ' phase 8 precipitates 9 comprise an intermetallic compound comprising $[(Co,Ni)_3(Al,W)]$ and have an $L1_2$ crystal structure. The lattice mismatch between the γ matrix 6 and the γ' phase 8 precipitates 9 dispersed therein that is used as a strengthening phase in the disclosed Co—Ni-base alloys 2 may be up to about 0.5%. This is significantly less than the mismatch of the lattice constant between the γ matrix 6 and the γ' phase precipitates comprising $Co_3Ti$ and/or $Co_3Ta$ in Co-base alloys, where the lattice mismatch may be 1% or more, and which have a lower creep resistance than the alloys disclosed herein. Further, by controlling the aluminum content of the Co—Ni-base alloys disclosed herein, as well as the contents of other alloy constituents such as Cr, Ni, W, Ta and Ti, the alloys provide a continuous, protective, adherent, aluminum oxide layer 4 on the alloy surface that continues to grow and increase in thickness and provide enhanced protection during their high-temperature use. However, the high-temperature growth of the oxide layer 4 is generally slower than that of oxides that grow during high temperature exposure of Co-base alloys to similar oxidizing environments and that are generally characterized by discontinuous oxide layers that do not protect these alloys from oxidation due to spallation. Spallation is undesirable because the area where the protective oxide is removed from the surface leaves an open area of the base alloy that is unprotected from the environment and particularly allows oxygen to contact with alloy surface. This exposure of the base alloy to the environment causes oxidation of the base alloy which may cause reduction of the material from the surface as well as detrimental effects such as preferential oxidation of the grain boundaries resulting in material degradation in properties and eventual failure of the alloy article.

The size and volume quantity of the γ' phase 8 $[(Co,NO_3(Al,W)]$ precipitates 9 may be controlled to provide a predetermined particle size, such as a predetermined average particle size, and/or a predetermined volume quantity, by appropriate selection and processing of the alloys, including selection of the constituent amounts of the elements comprising the precipitates, as well as appropriate time and temperature control during solution heat treatment and aging heat treatment, as described herein. In one exemplary embodiment, the γ' phase 8 $[(Co,Ni)_3(Al,W)]$ precipitates 9 may be precipitated under conditions where the average precipitate particle diameter is about 1 μm or less, and more particularly about 500 nm or less. In another exemplary embodiment, the precipitates may be precipitated under conditions where their volume fraction is about 20 to about 80%, and more particularly about 30 to about 70%. For larger particle diameters, the mechanical properties such as strength and hardness may be reduced. For smaller precipitate amounts, the strengthening is insufficient.

In some embodiments of the Co—Ni-base alloys 2 of the present invention, the alloy constituents have been described generally as comprising, in weight percent, about 3.5 to about 4.9% of Al, about 12.2 to about 16.0% of W, about 24.5 to about 32.0% Ni, about 6.5% to about 10.0% Cr, about 5.9% to about 11.0% Ta, and the balance Co and incidental impurities. The amounts of Ni and Al will generally be selected to provide sufficient amounts of these constituents to form a predetermined volume quantity and/or predetermined particle size of $[(Co,Ni)_3(Al,W)]$ precipitates, which contribute to the desirable high-temperature alloy characteristics described above. In addition, other alloy constituents may be selected to promote the high-temperature properties of the alloy, particularly the formation and high-temperature stability over time of the $[(Co,Ni)_3(Al,W)]$ precipitates 9, the formation and growth of the adherent, continuous, protective, adherent oxide layer 4 on the surface and ensuring that the alloy 2 is substantially free of the CoAl beta phase.

Ni is a major constituent of the γ and γ' phases. The amount of Ni is also selected to promote formation of $[(Co,Ni)_3(Al,W)]$ precipitates having the desirable $L1_2$ crystal structure that provide the reduced lattice mismatch as compared to Co-base alloys and to improve oxidation resistance.

Al is also a major constituent of the γ' phase 8 and also contributes to the improvement in oxidation resistance by formation of an adherent, continuous aluminum oxide layer 4 on the surface, which in an exemplary embodiment comprises alumina 5 ($Al_2O_3$). The amount of aluminum included in the alloy must be sufficiently large to form the continuous, protective, adherent aluminum oxide layer 4 on the surface, and may also be selected to provide sufficient aluminum to enable continued growth of the thickness of the oxide layer 4 on the surface during high-temperature operation of articles formed from the alloy. The amount of aluminum included in these alloys must be also be sufficiently small to ensure that the alloys are substantially free of the CoAl beta phase with a B2 crystal structure, since the presence of this phase tends to significantly reduce their high temperature strength.

W is also a major constituent element of the γ' phase 8 and also has an effect of solid solution strengthening of the matrix, particularly due to its larger atomic size as compared to that of Co, Ni and Al. In an exemplary embodiment, the alloy 2 may include about 12.2 to about 16.0% by weight of W. Lower amounts of W will result in formation of an insufficient volume fraction of γ' phase and higher amounts of W will result in the formation of undesirable amount of W-rich phases, such as μ-$Co_7W_6$ and $Co_3W$ phases. Formation of small amount W-rich phases along grain boundaries can be beneficial to suppress grain coarsening. However, formation of large amount of W-rich phases can degrade mechanical properties, including ductility. More particularly, in one embodiment the amount of W may include about 12.2 to about 14.2% by weight, and even more particularly about 13.2% by weight. In another embodiment, the amount of W may include about 14.0 to about 16.0% by weight, and even more particularly about 15.0% by weight.

In addition, the Co—Ni-base alloys 2 disclosed herein may also include a predetermined amount of Si or S, or a combination thereof. In another exemplary embodiment, Si may be present in an amount effective to enhance the oxidation resistance of the Co—Ni base alloys, and may include about 0.01% to about 1% by weight of the alloy. In yet another exemplary embodiment, S may be controlled as an incidental impurity to also enhance the oxidation resistance of the Co—Ni base alloys, and may be reduced to an amount of less than about 5 parts per million (ppm) by weight of the alloys, and more particularly may be reduced to an amount of less than about 1 ppm by weight of the alloys. The reduction of S as an incidental impurity to the levels described is generally effective to improve the oxidation resistance of the alloys 2 and improve alumina scale adhesion, resulting in adherent oxide scales that are resistant to spallation.

Further, the Co—Ni-base alloys 2 disclosed herein may also include a predetermined amount of Ti effective to promote the formation of the continuous, protective, adherent oxide layer on the alloy surface. In one exemplary embodiment, Ti may include up to about 10% by weight of the alloy, and more particularly up to about 5% by weight of the alloy, and even more particularly about 0.1% to about 5% by weight of the alloy.

These Co—Ni-base alloys 2 are advantageously substantially free of macro segregation of the alloy constituents, particularly Al, Ti or W, or a combination thereof, such as is known to occur in Ni-base superalloys upon solidification. More particularly, these alloys are substantially free of macro segregation of the alloy constituents, including those mentioned, in the interdendritic spaces of castings. This is a particularly desirable aspect at the surface of these alloys because macro segregation can cause pits or pimples (protrusions) to form at the alloy surface of Ni-base superalloys during high temperature oxidation. Such pits or pimples are mixed oxides or spinel, such as mixed oxides of magnesium, ferrous iron, zinc, and/or manganese, in any combination.

Other alloy constituents may be selected to modify the properties of the Co—Ni-base alloys 2. In an exemplary embodiment, constituents may include B, C, Y, Sc, lanthanides, misch metal, and combinations comprising at least one of the foregoing. In one exemplary embodiment the total content of constituents from this group may include about 0.001 to about 2.0% by weight of the alloy.

B is generally segregated in the γ phase 6 grain boundaries and contributes to the improvement in the high temperature strength of the alloys. The addition of B in amounts of about 0.001% to about 0.5% by weight is generally effective to increase the strength and ductility of the alloy, and more particularly about 0.001% to about 0.1% by weight.

C is also generally segregated in the γ phase 6 grain boundaries and contributes to the improvement in the high temperature strength of the alloys. It is generally precipitated as a metal carbide to enhance the high-temperature strength. The addition of C in amounts of about 0.001% to about 1% by weight is generally effective to increase the strength of the alloy, and more particularly about 0.001% to about 0.5% by weight.

Y, Sc, the lanthanide elements, and misch metal are generally effective in improving the high-temperature oxidation resistance of the alloys. The addition of these elements, in total, in amounts of about 0.001% to about 0.5% by weight is generally effective to improve the oxidation resistance of the alloy and improve oxide, such as aluminum oxide, scale adhesion, and more particularly about 0.001% to about 0.2% by weight. These elements may also be included together with control of the sulfur content to improve the oxidation resistance of these alloys 2 and improve alumina scale adhesion. When reactive elements or rare earths are employed in these alloys 2, it is desirable that the materials of the ceramic systems used as casting molds which contact the alloy be selected to avoid depletion of these elements at the alloy 2 surface. Thus, the use of Si-based ceramics in contact with the alloy 2 surface is generally undesirable, as they cause depletion of rare earth elements in the alloy which can react with the Si-based ceramics to form lower melting point phases. In turn, this can result in defects leading to lower low cycle fatigue (LCF) strength and reduced creep strength. The use of ceramic systems that employ non-reactive face coats on the ceramic (e.g., $Y_2O_3$ flour) or Al-based ceramics is desirable when reactive elements or rare earth elements are employed as alloy 2 constituents.

Mo may be employed as an alloy constituent to promote stabilization of the γ' phase and provide solid solution strengthening of the γ matrix. The addition of Mo in amounts of up to about 5% by weight is generally effective to provide these benefits, and more particularly up to about 3% by weight, and even more particularly about 0.1% to about 3% by weight.

Ta may comprise about 5.9% to about 11.0% by weight of the alloy. Other elements (X) may be partly substituted for Ta, where X is Ti, Nb, Zr, Ta, Hf, and combinations thereof, as alloy constituents to provide stabilization of the γ' phase 8 and improvement of the high temperature strength of Co—Ni-base alloys 2. As indicated, the amount of these elements in total may include about 5.9% to about 11.0% by weight of the alloy. More particularly, in one embodiment the amount of X may include, by weight, about 5.9% to about 7.9%, and even more particularly about 6.9%. In another embodiment the amount of X may include, by weight, about 9.0% to about 11.0%, and even more particularly about 10.0% of the alloy. Amounts in excess of these limits may reduce the high-temperature strength and reduce the solidus temperature of the alloy, thereby reducing its operating temperature range, and more particularly its maximum operating temperature.

In some embodiments, incidental impurities may include V, Mn, Fe, Cu, Mg, S, P, N or O, or combinations comprising at least one of the foregoing. Where present, incidental impurities are generally limited to amounts effective to provide alloys having the alloy properties described herein, which in some embodiments may include less than about 100 ppm by weight of the alloy of a given impurity.

Figure 13:
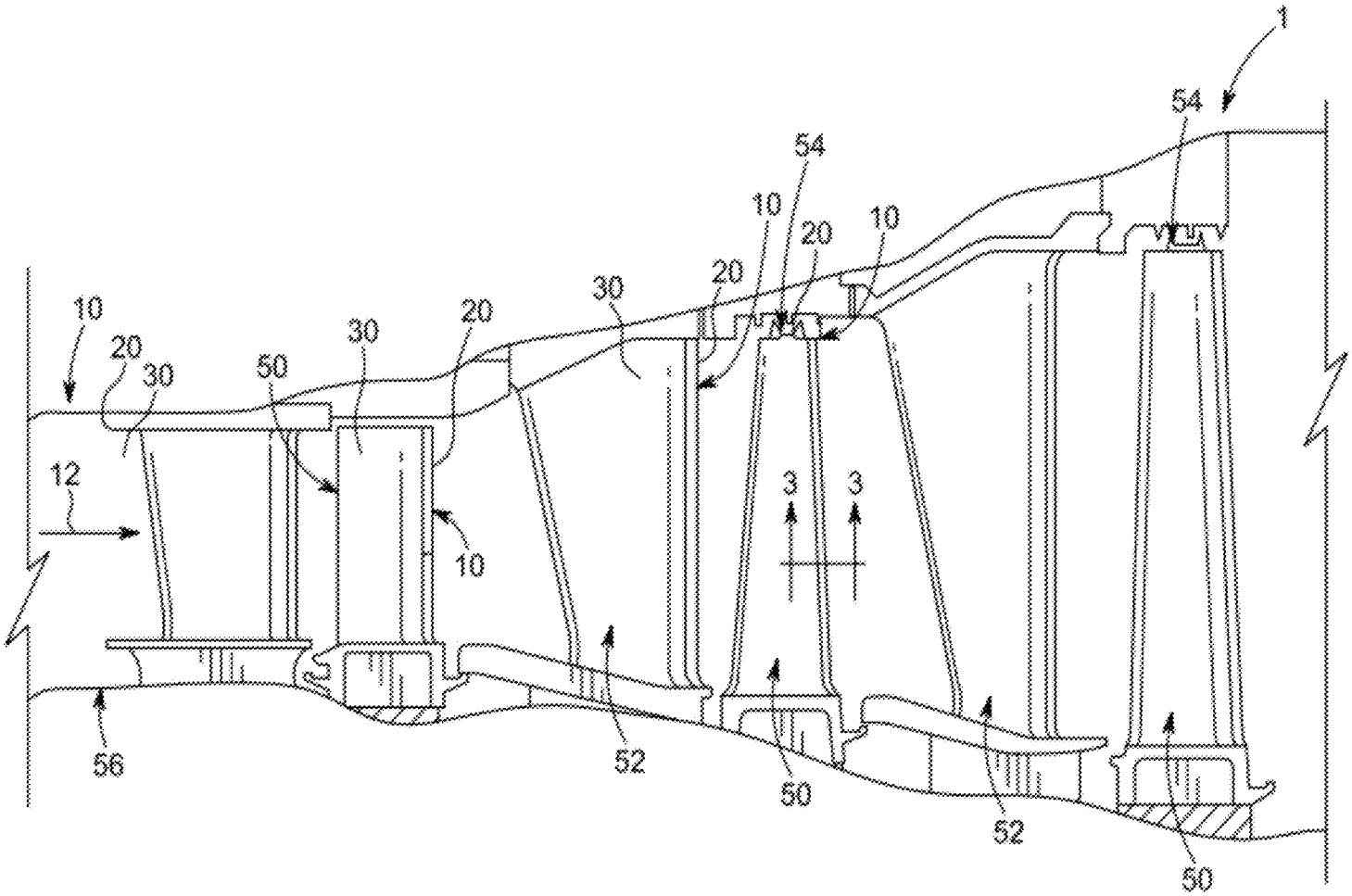
FIG. 13 is a schematic cross-sectional view of an exemplary embodiment of certain high-temperature articles and a turbine engine as disclosed herein.

As illustrated in FIG. 13, the Co—Ni-base alloys 2 disclosed herein may be used to make various high-temperature articles 10 having the high-temperature strength, ductility, oxidation resistance and corrosion resistance described herein. These articles 10 include components 20 that have surfaces 30 that comprise the hot gas flowpath 40 of a gas turbine engine, such as an industrial gas turbine engine. These components 20 include turbine buckets or blades 50, vanes 52, shrouds 54, liners 56, combustors and transition pieces (not shown) and the like.

Figure 14:
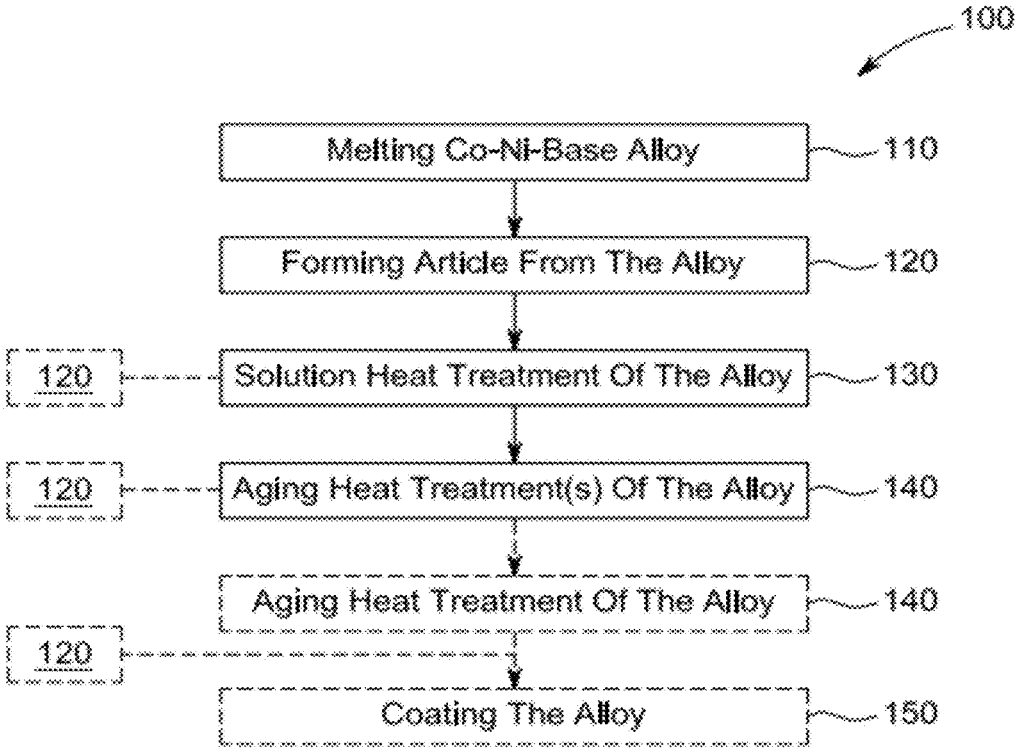
FIG. 14 is a flow chart of an exemplary embodiment of a method of making the alloy as disclosed herein.

Referring to FIG. 14, these articles 10 having high-temperature strength, oxidation resistance and corrosion resistance may be made by a method 100, comprising: forming 110 a cobalt-nickel base alloy, comprising, in weight percent: about 3.5 to about 4.9% of Al, about 12.2 to about 16.0% of W, about 24.5 to about 32.0% Ni, about 6.5% to about 10.0% Cr, about 5.9% to about 11.0% Ta, and the balance Co and incidental impurities; forming 120 an article from the cobalt-nickel base alloy 2; solution-treating 130 the cobalt-nickel base alloy 2 by a solution heat treatment at a solutionizing temperature that is above the γ' solvus temperature and below the solidus temperature for a predetermined solution-treatment time to homogenize the microstructure; and aging 140 the cobalt-nickel base alloy by providing at least one aging heat treatment at an aging temperature that is less than the gamma-prime solvus temperature for a predetermined aging time to form an alloy microstructure that comprises a plurality of gamma prime precipitates comprising $(Co,Ni)_3(Al,W)$ and is substantially free of a CoAl phase having a B2 crystal structure. Method 100 may optionally include coating 150 the alloy 2 with a protective coating.

Melting or forming 110 of the Co—Ni-base alloy 2 may be performed by any suitable forming method, including various melting methods, such as vacuum induction melting (VIM), vacuum arc remelting (VAR) or electro-slag remelting (ESR). In the case where the molten Co—Ni-base alloy, which is adjusted to a predetermined composition, is used as a casting material, it may be produced by any suitable casting method, including various investment casting, directional solidification or single crystal solidification methods.

Forming 120 of an article 10 having a predetermined shape from the cobalt-nickel base alloy 2 may be done by any suitable forming method. In an exemplary embodiment, the cast alloy can be hot-worked, such as by forging at a solution treatment temperature and may also, or alternatively, be cold-worked. Therefore, the Co—Ni-base alloy 2 can be formed into many intermediate shapes, including various forging billets, plates, bars, wire rods and the like. It can also be processed into many finished or near net shape articles 10 having many different predetermined shapes, including those described herein. Forming 120 may be done prior to solution-treating 130 as illustrated in FIG. 14. Alternately, forming may be performed in conjunction with either solution-treating 130 or aging 140, or both of them, or may be performed afterward.

Solution-treating 130 of the cobalt-nickel base alloy 2 may be performed by a solution heat treatment at a solutionizing temperature that is between the γ' solvus temperature and the solidus temperature for a predetermined solution-treatment time. The Co—Ni-base alloy 2 is formed into an article 10 having a predetermined shape and then heated at the solutionizing temperature. In an exemplary embodiment, the solutionizing temperature may be between about 1100 to about 1400° C., and more particularly may be between about 1150 to about 1300° C., for a duration of about 0.5 to about 12 hours. The strain introduced by forming 120 is removed and the precipitates are solutionized by being dissolved into the matrix 6 in order to homogenize the material. At temperatures below the solvus temperature, neither the removal of strain nor the solutionizing of precipitates is accomplished. When the solutionizing temperature exceeds the solidus temperature, some liquid phase is formed, which reduces the high-temperature strength of the article 10.

Aging 140 of the cobalt-nickel base alloy 2 is performed by providing at least one aging heat treatment at an aging temperature that is lower than the γ' solvus temperature for a predetermined aging time, where the time is sufficient to form an alloy microstructure that comprises a plurality of γ' precipitates comprising $[(Co,Ni)_3(Al,W)]$ and is substantially free of a CoAl phase having a B2 crystal structure. In an exemplary embodiment, the aging treatment may be performed at a temperature of about 700 to about 1200° C., to precipitate $[(Co,NO_3(Al,W)]$ having an $L1_2$-type crystal structure that has a lower lattice constant mismatch between the γ' precipitate and the γ matrix. The cooling rate from the solution-treating 130 to aging 140 may also be used to control aspects of the precipitation of the γ' phase, including the precipitate size and distribution within the γ matrix. The aging heat treatment may be conducted in one, or optionally, in more than one heat treatment step, including two steps and three steps. The heat treatment temperature may be varied as a function of time within a given step. In the case of more than one step, the steps may be performed at different temperatures and for different durations, such as for example, a first step at a higher temperature and a second step at a somewhat lower temperature.

Either or both of solution treating 130 and aging 140 heat treatments may be performed in a heat treating environment that is selected to reduce the formation of the surface oxide, including vacuum, inert gas and reducing atmosphere heat treating environments. This may be employed, for example, to limit the formation of the oxide layer 4 on the surface of the alloy prior to coating the surface of the alloy with a thermal barrier coating material to improve the bonding of the coating material to the alloy surface.

Referring to FIGS. 3 and 14, coating 150 may be performed by coating the alloy 2 with any suitable protective coating material, including various metallic bond coat materials, thermal barrier coating materials, such as ceramics comprising yttria stabilized zirconia, and combinations of these materials. When these protective coatings are employed, the oxidation resistance of the alloy 2 improves the oxidation resistance of the coated components and the coating compatibility, such as by improving the spallation resistance of thermal barrier coatings applied to the surface of the alloy 2.

In a Ni—Al binary system, γ' is a thermodynamically stable $Ni_3Al$ phase with an $L1_2$ crystal structure in an equilibrium phase diagram and is used as a strengthening phase. Thus, in Ni-base alloys using this system as a basic system, γ' has been used as a primary strengthening phase. In contrast, in an equilibrium phase diagram of the Co—Al binary system, a γ' $Co_3Al$ phase is not present and has been reported that the γ' phase is a metastable phase. The metastable γ' phase has reportedly been stabilized by the addition of W in order to use the γ' phase as a strengthening phase of various Co-base alloys. Without being bound by theory, in the Co—Ni solid solution alloys disclosed herein, the γ' phase described as a $[(Co,Ni)_3(Al,W)]$ phase with an $L1_2$ crystal structure may comprise a mixture of a thermodynamically stable $Ni_3Al$ with an $L1_2$ crystal structure and metastable $Co_3(Al,W)$ that is stabilized by the presence of W that also has an $L1_2$ crystal structure. In any case, the γ' phase comprising a $[(Co,Ni)_3(Al,W)]$ phase with an $L1_2$ crystal structure is precipitated as a thermodynamically stable phase.

In an exemplary embodiment, the γ' phase intermetallic compound $[(Co,Ni)_3(Al,W)]$ is precipitated according to method 100, and more particularly aging 140, in the γ phase matrix 6 under conditions sufficient to provide a particle diameter of about 1 μm or less, and more particularly, about 10 nm to about 1 μm, and even more particularly about 50 nm to about 500 nm, and the amount of γ' phase precipitated is about 20% or more by volume, and more particularly about 30 to about 70% by volume.

Examples

The alloys disclosed herein, and more particularly set forth in this example, have the compositions set forth in FIG. 1, with alloys Co-01 and Co-02, and more particularly alloy Co-01, demonstrating particularly desirable combinations of alloy properties as described herein. With reference to FIG. 3 in the drawings, the alloys according to the invention are comprised of a γ matrix 6 and γ' phase 8 precipitates 9 dispersed therein wherein the γ' phase 8 precipitates 9 comprise an intermetallic compound comprising $[(Co,Ni)_3(Al,W)]$ and have an $L1_2$ crystal structure. In composition Co-01 the volume fraction of the precipitates 9 in Co-01 is 38%. For example, these alloys have the thermodynamic properties set forth in FIG. 2 and demonstrate a gamma prime solvus temperature of at least about 1050° C. and a solution window between a solidus temperature and the gamma prime solvus temperature of greater than or equal to about 150° C., and more particularly greater than or equal to about 200° C. This is a very advantageous property because it provides a relatively large temperature range over which the alloys 2 may be thermomechanically processed by forging, extrusion, rolling, hot isostatic pressing and other forming processes to form the articles 10 described herein.

Figure 5A:
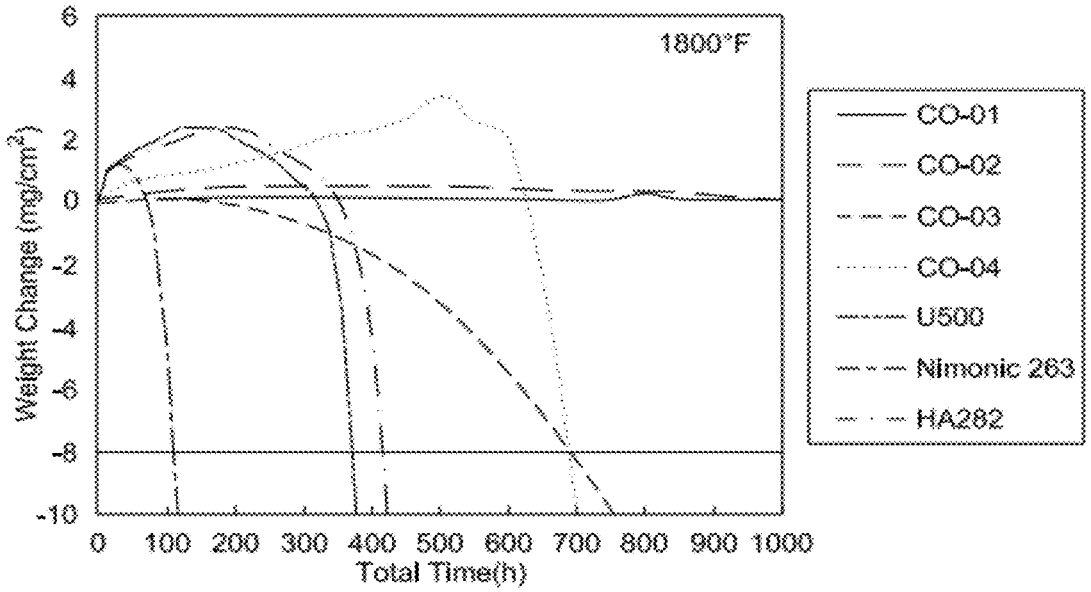
FIG. 5A is a plot of weight change as a function of time at 1800° F. in a cyclic oxidizing environment for several alloys as disclosed herein and several comparative Co-base alloys.
Figure 5B:
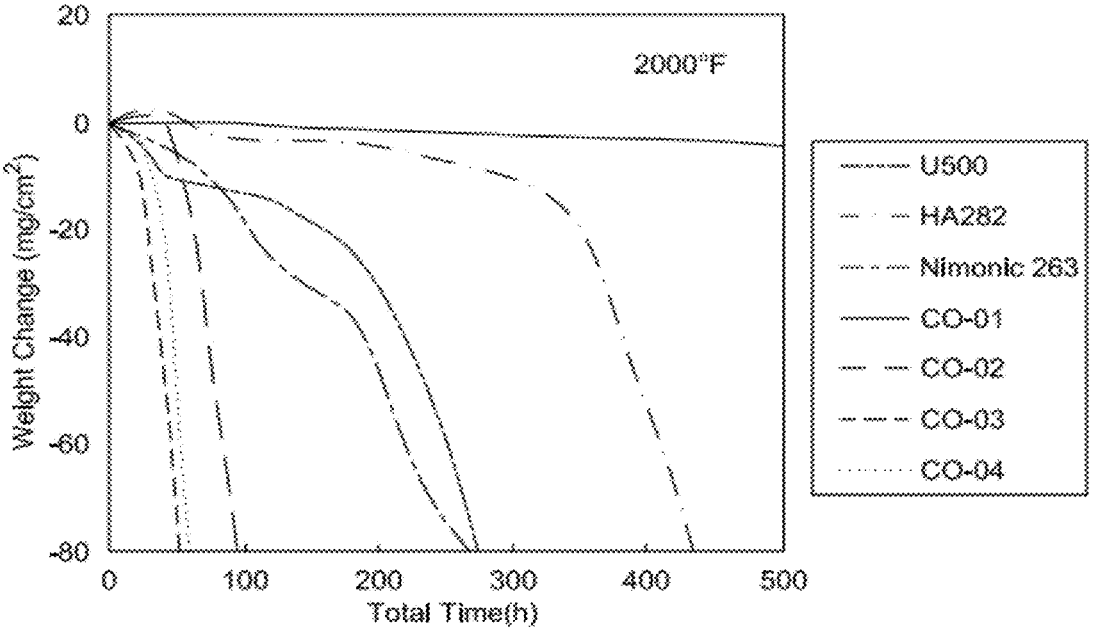
FIG. 5B is a plot of weight change as a function of time at 2000° F. in a cyclic oxidizing environment for several alloys as disclosed herein and several comparative Ni-base alloys.

In another example, these alloys 2 have superior high-temperature oxidation resistance as compared to conventional Co-base or Ni-base alloys as illustrated in FIGS. 5A (1,800° F.) and 5B (2000° F.) which show the results from extended high-temperature cyclic oxidation tests where the alloys are repeated cycled from ambient or room temperature to a high-temperature (e.g., 1,800° F. or 2,000° F.) in an oxidizing environment (e.g., air). Alloys Co-01 and Co-02 showed no degradation out to 1000 hours at 1,800° F., and alloy Co-01, showed only very small degradation out to 1000 hours at 2,000° F.

Figure 6:
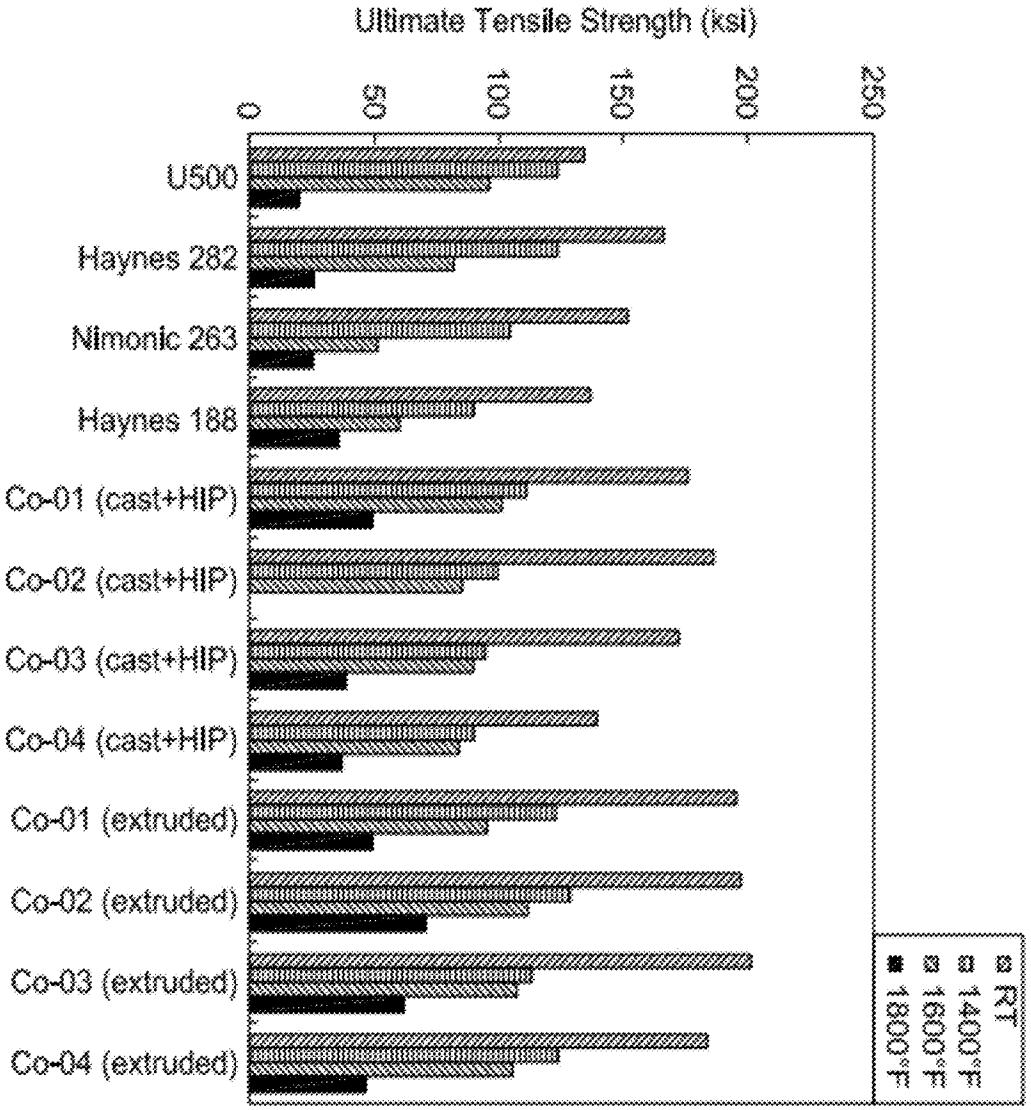
FIG. 6 is a plot of the ultimate tensile strength of several alloys as disclosed herein and several comparative Ni-base alloys as a function of temperature.
Figure 7:
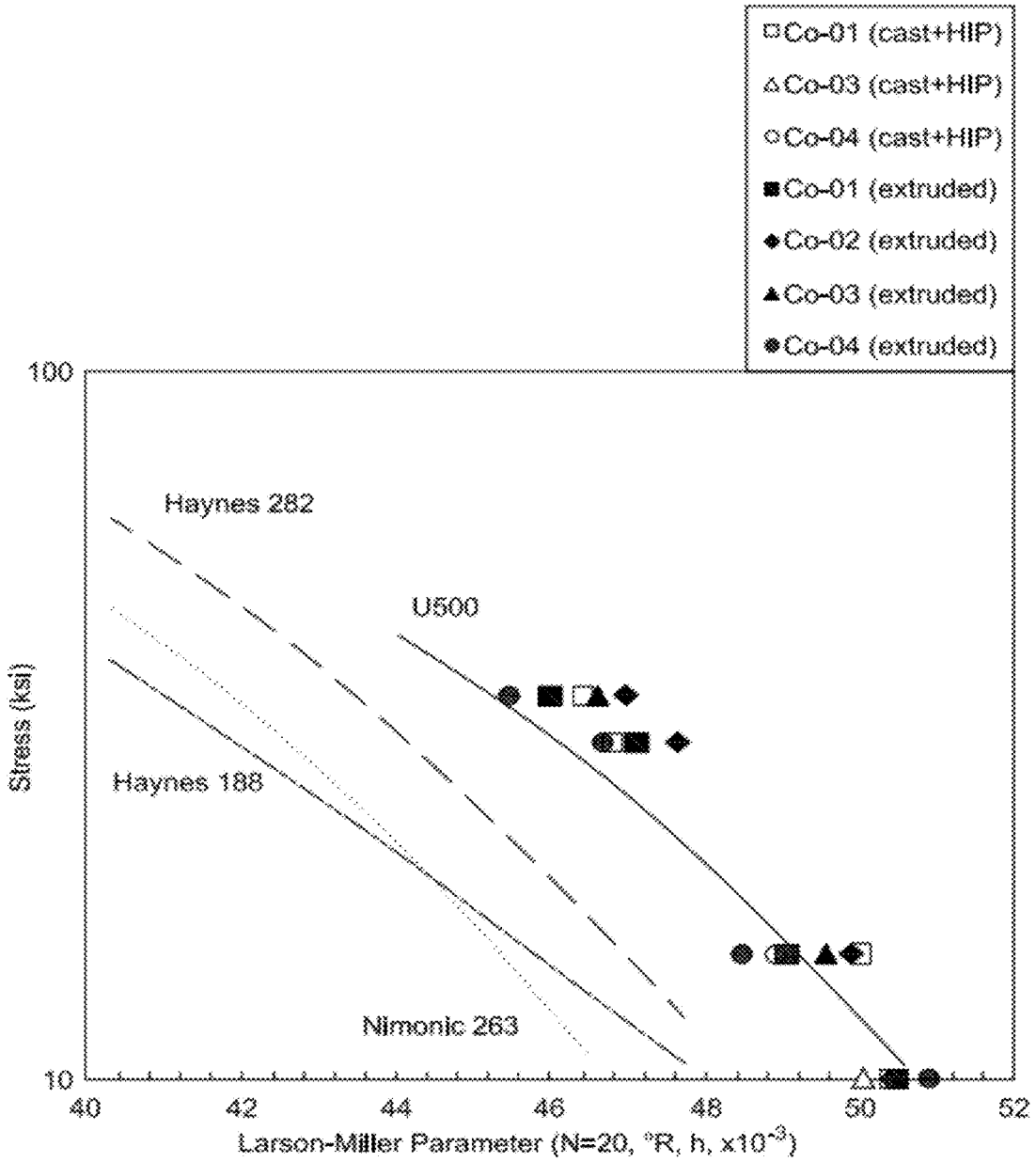
FIG. 7 is a plot of creep rupture properties for the alloys of FIG. 5 plotted as the Larson-Miller parameter as a function of stress.
Figure 9:
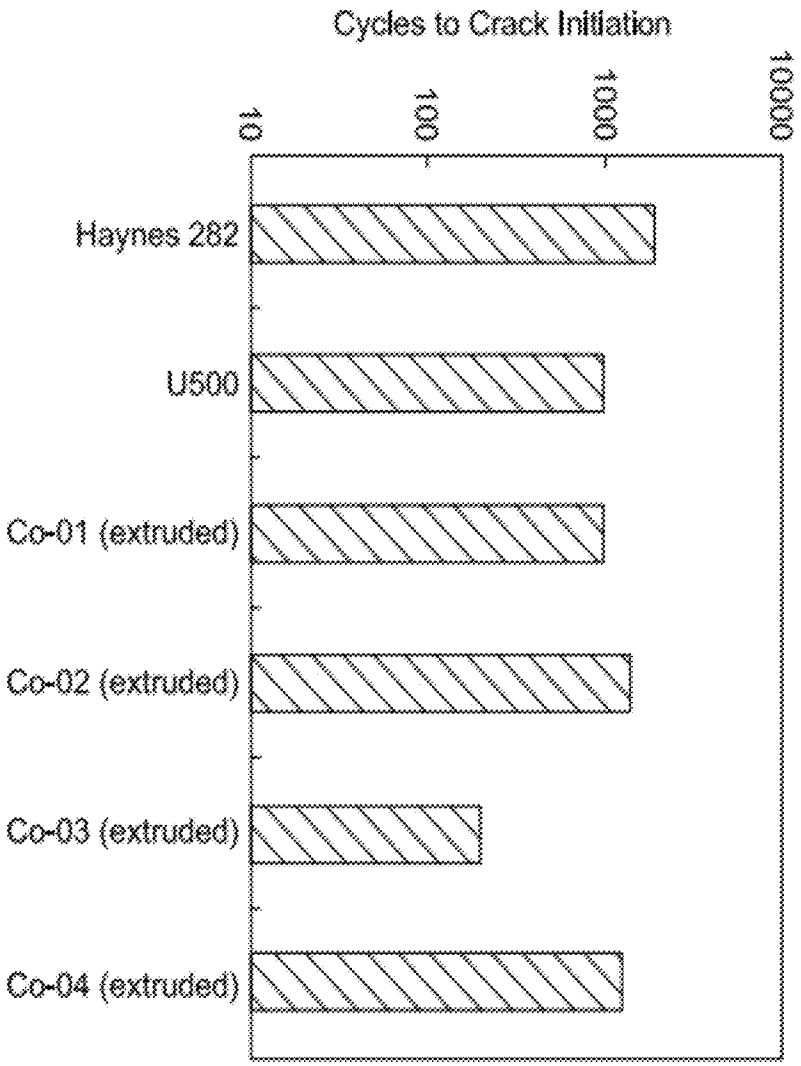
FIG. 9 is a plot of cycles to crack initiation for the alloys of FIG. 1 and comparative alloys illustrating the hold-time low cycle fatigue properties at 1800° F., A=−1, 2 min. hold time and a total strain range of 0.4%.

The alloys 2 have ultimate tensile strengths that are comparable to, and generally higher than, conventional Co-base or Ni-base alloys, both at room temperature and at high-temperatures in the range of 1,600° F. to 2,000° F., as illustrated in FIG. 6. The alloys 2 also have excellent high-temperature creep rupture strengths that are comparable to, and generally higher than, conventional Co-base or Ni-base alloys as illustrated in FIGS. 7 and 8.

Figures 10, 11:
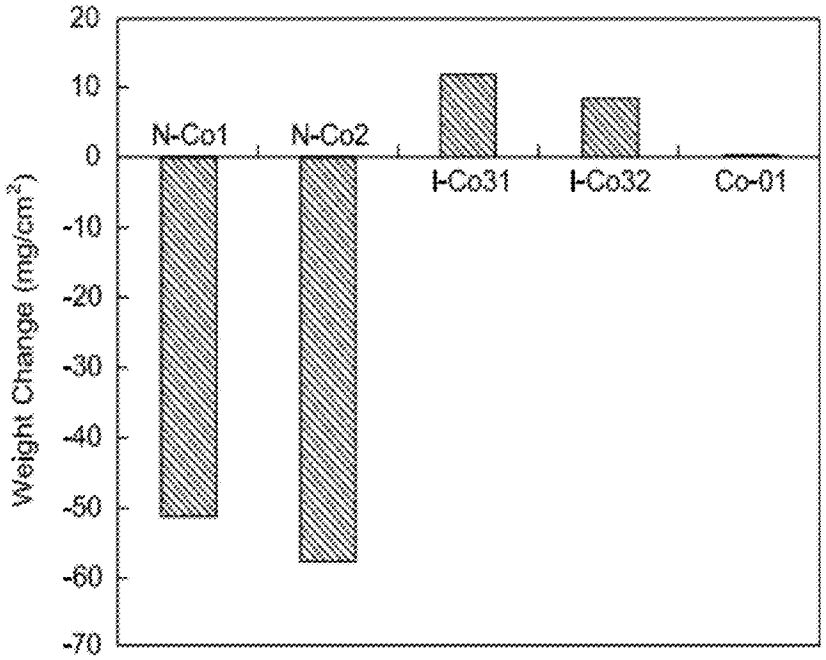
FIG. 10 is a table of alloy compositions for several comparative related art Co-base and Co—Ni base alloys.
FIG. 11 is a plot of weight change after exposure at 1800° F. for 100 hours in an isothermal oxidizing environment for the comparative alloys of FIG. 9 and an alloy of FIG. 1.

Oxidation resistance of one of the alloys was also compared to several other related art alloys as described in US2008/0185078 (alloys 31 and 32, Table 6) and US2010/0061883 (alloys Co-01 and Co-02, Table 2), which were also prepared, as were the alloys of FIG. 1, by induction melting. The related art alloy compositions are shown in FIG. 10. The alloys of FIGS. 1 and 10 were solution heat treated at 1250° C. for 4 hours in argon. Specimens 0.125 inches (3.2 mm) thick were sliced from the solutionized materials, and flat surfaces were polished using 600 grit sandpaper. The test coupons were then exposed to a high-temperature oxidizing environment (e.g., air) as part of an isothermal oxidation test at 1800° F. (982° C.) for 100 h and the weights were measured before and after the oxidation tests. The results are shown in FIG. 11 which plots the weight change due to oxidation. The related art alloys showed either significant weight reduction due to oxide spallation or weight gain due to formation of thick oxide layers. The related art alloys showed significant surface and subsurface oxidation, including spallation of the surface oxide layer in sample I—Co31. These alloys microstructures are illustrated in the micrographs of FIGS. 12A-12D. Alloy N—Co1 forms CoO 100 and a complex oxide enriched with W and Co 102 that shows the gap between metal and oxide layer is formed during cooling from 1800° F. due to larger thermal expansion coefficient of metals than that of oxides and a substantial internal oxidation layer 104 (FIG. 12A) (about 50 microns). Alloy N—Co2 also forms a relatively thick layer of CoO 100 and a W,Co-rich oxide 102 on the surface and an internal oxidation layer 104 (FIG. 12B). The total thickness of oxides and internally oxidized layers is 60-100 microns. This alloy also formed a significant amount of undesirable beta-CoAl phase throughout the alloy microstructure. This alloy indicates that simply increasing Al content of related art alloys is not sufficient to achieve the combination of oxidation resistance and avoidance of undesirable phase formation disclosed herein. Alloy I—Co31 forms CoO 100 that spalled away and a relatively thick W,Co-rich oxide layer 102 on the surface, as well as exhibiting an internal oxidation layer 104 (FIG. 12C). Alloy I—Co32 forms a relatively thick layer of CoO 100 and W,Co-rich oxide 102 on the surface, as well as exhibiting an internal oxidation layer 104 (FIG. 12D). The properties disclosed herein, including oxidation resistance (alumina-former) and avoidance of formation of undesired phases (such as beta-CoAl phase), may be achieved using the compositions disclosed herein. The alloy disclosed herein showed significantly improved oxidation resistance, including substantially no weight gain and exhibited a thin (less than 10 microns thick), adherent surface oxide layer 106 comprising substantially alumina with a few spinel intermixed and substantially no spallation or internal (subsurface) oxidation as illustrated in FIG. 12E, thereby demonstrating the improvement over the related art alloys.

The terms "first," "second," and the like, "primary," "secondary," and the like, as used herein do not denote any order, quantity, or importance, but rather are used to distinguish one element from another.

The terms "a" and "an" do not denote a limitation of quantity, but rather denote the presence of at least one of the referenced item.

Unless defined otherwise, technical and scientific terms used herein have the same meaning as is commonly understood by one of skill in the art to which this invention belongs.

The modifier "about" used in connection with a quantity is inclusive of the stated value and has the meaning dictated by the context (e.g., includes the degree of error associated with measurement of the particular quantity). The endpoints of all ranges directed to the same component or property are inclusive of the endpoint and independently combinable.

As used herein, "combination" is inclusive of blends, mixtures, alloys, reaction products, and the like.

Reference throughout the specification to "one embodiment", "another embodiment", "an embodiment", and so forth, means that a particular element (e.g., feature, structure, and/or characteristic) described in connection with the embodiment is included in at least one embodiment described herein, and may or may not be present in other embodiments. In addition, it is to be understood that the described elements may be combined in any suitable manner in the various embodiments.

In general, the compositions or methods may alternatively comprise, consist of, or consist essentially of, any appropriate components or steps herein disclosed. The invention may additionally, or alternatively, be formulated so as to be devoid, or substantially free, of any components, materials, ingredients, adjuvants, or species, or steps used in the prior art compositions or that are otherwise not necessary to the achievement of the function and/or objectives of the present claims.

As used herein, unless the text specifically indicates otherwise, reference to a weight or volume percent of a particular alloy constituent or combination of constituents, or phase or combination of phases, refers to its percentage by weight or volume of the overall alloy, including all of the alloy constituents.

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description, but is only limited by the scope of the appended claims.

The invention claimed is:

1. An alloy, comprising, in weight percent: 4.4% of Al, 13.2% of W, 30% of Ni, 9.5% of Cr, 6.9 of Ta, and the balance Co and incidental impurities wherein the alloy comprises gamma prime precipitates comprising $[(Co,Ni)_3(Al,W)]$ having an L12 crystal structure and wherein the alloy has a gamma prime solvus temperature of at least 1050° C.

2. The alloy of claim 1, wherein the alloy is configured to provide an adherent, protective oxide layer and subsurface oxidation resistance and/or resistance to oxide spallation up to at least 1800° F.

3. The alloy of claim 1, further comprising up to about 0.50% of C or up to about 0.1% of B, or a combination thereof, by weight of the alloy.

4. The alloy of claim 1, further comprising up to about 0.1%, of a material selected from the group consisting of Y, Sc, a lanthanide element, misch metal, and combinations thereof.

5. The alloy of claim 1, wherein the alloy comprises, in weight percent, about 30% to about 45% Co.

6. The alloy of claim 1, wherein the amount of gamma prime phase precipitates is about 20% to 38% by volume.

7. The alloy of claim 1, wherein the alloy has a solution window between a solidus temperature and a gamma prime solvus temperature of greater than or equal to 150° C.

8. The alloy of claim 1, wherein the alloy comprises a turbine engine component.

9. An alloy, comprising, in weight percent: 4.4% of Al, 13.2% of W, 30% of Ni, 9.5% of Cr, 6.9% of Ta, and the balance Co and incidental impurities wherein the alloy comprises gamma prime precipitates comprising [(Co,Ni)3(Al,W)] having an L12 crystal structure; and wherein the amount of gamma prime phase precipitates is about 20% to about 70% by volume.

10. The alloy of claim 9, wherein the alloy is configured to provide an adherent, protective oxide layer and subsurface oxidation resistance and/or resistance to oxide spallation up to at least 1800° F.

11. The alloy of claim 9, further comprising up to about 0.50% of C or up to about 0.1% of B, or a combination thereof, by weight of the alloy.

12. The alloy of claim 9, further comprising up to about 0.1%, of a material selected from the group consisting of Y, Sc, a lanthanide element, misch metal, and combinations thereof.

13. The alloy of claim 9, wherein the alloy comprises, in weight percent, about 30% to about 45% Co.

14. The alloy of claim 9 wherein the alloy has a solution window between a solidus temperature and a gamma prime solvus temperature of greater than or equal to 150° C.

15. The alloy of claim 9, wherein the alloy comprises a turbine engine component.

16. An alloy, comprising, in weight percent: 4.4% of Al, 13.2% of W, 30% of Ni, 9.5% of Cr, 6.9% of Ta, and the balance Co and incidental impurities wherein the alloy comprises gamma prime precipitates comprising [(Co,Ni)3(Al,W)] having an L12 crystal structure; and wherein the amount of gamma prime phase precipitates is about 20% to about 70% by volume; and wherein the alloy has a gamma prime solvus temperature of at least 1050° C.

* * * * *